United States Patent [19]

Sinclair

[11] Patent Number: 4,936,589

[45] Date of Patent: Jun. 26, 1990

[54] BOARD GAME APPARATUS

[76] Inventor: Michael D. Sinclair, 910 Cornell Avenue, Coquitlam, Canada, B.C. V3J 2Z5

[21] Appl. No.: 229,277

[22] Filed: Aug. 8, 1988

[51] Int. Cl.[5] ..... A63F 3/00

[52] U.S. Cl. ..... 273/249; 273/256

[58] Field of Search ..... 273/256, 243, 249

[56] References Cited

U.S. PATENT DOCUMENTS

| | | | |
|---|---|---|---|
| 2,693,961 | 11/1954 | Ripley | 273/256 |
| 2,976,044 | 3/1961 | Corpening | 273/256 |
| 4,053,157 | 10/1977 | Cowan | 273/256 |
| 4,065,131 | 12/1977 | Martin et al. | 273/243 |
| 4,089,527 | 5/1978 | Roth | 273/249 |
| 4,452,457 | 6/1984 | Atieh et al. | 273/256 |

*Primary Examiner*—Benjamin Layno

*Attorney, Agent, or Firm*—Barrigan & Oyen

[57] ABSTRACT

A board game is described which simulates the acquiring of employment in various jobs, the receiving of paychecks, the paying of bills, and the receiving or paying of benefit checks associated with the status of being employed or unemployed. Players move their playing pieces along the game board path according to the roll of dice. According to the rules, a player can acquire employment by landing on a company space, rolling the dice and receiving the appropriate job credit card. Certain other spaces on the path have instructions for paying bills, receiving Welfare and Unemployment benefit checks, and paying Welfare and Unemployment benefit checks. A timing piece moves around the circumference of the board with each roll of the players' dice. Each circumnavigation of the board by the timing piece results in a payday. When payday occurs, employed players received paychecks corresponding to the jobs they currently hold. Players on the instruction spaces must pay the bank the corresponding bill, Welfare or Unemployment benefit check or must receive the appropriate Welfare or Unemployment benefit check.

4 Claims, 4 Drawing Sheets

BOARD GAME APPARATUS

FIELD OF THE INVENTION

The invention relates to board games and more particularly to board games for simulating the earning of income through employment.

BACKGROUND OF THE INVENTION

Various board games have been created in which the theme of the game is the earning of income through various careers. Typically, such games involve a board having a continuous path of spaces representing various careers or employment possibilities with each space designating a particular event or choice. Dice are rolled to move players around the board in a chance fashion and events are triggered when a player lands on a particular square. In the past, the sorts of events associated with a particular square have been typically the gain or loss of paying money, or further movement or restriction of movement on the board. Such games do not, however, simulate to any significant degree to the actual complexity and decisions involved in earning income from employment.

SUMMARY OF THE INVENTION

The present board game apparatus provides a simulation of the earning of employment income which is more realistic and entertaining than prior games. The game apparatus utilizes a paymaster piece which acts as a periodic timekeeper and moves with each roll of the dice. Individual players apply for and obtain jobs from which paychecks are received each payday. Certain qualifications for each job are required and more qualified employees may displace less qualified employees. The winner of the game is the party who has earned the most by the time of retirement.

DRAWINGS

In drawings which illustrate an embodiment of the invention:

DETAILED DESCRIPTION OF A PREFERRED EMBODIMENT OF THE INVENTION

Figure 1:
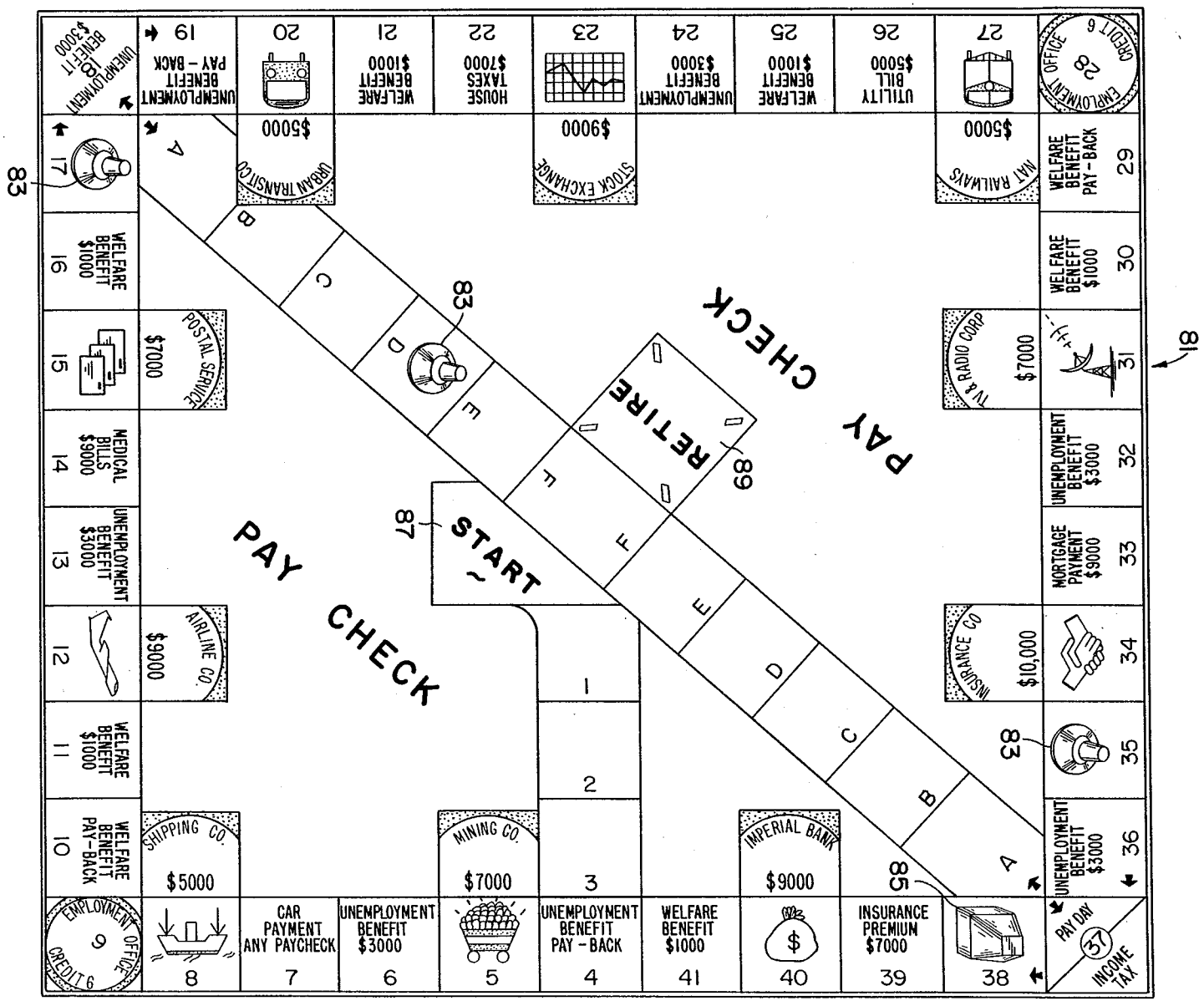
FIG. 1 shows the game board of the apparatus with playing pieces.

FIG. 1 shows the layout of the game board 81, playing pieces 83 and paymaster piece 85. The game board has spaces 4 through 41 forming a continuous path around the periphery of the game board, a starting square 87, squares 1, 2 and 3 leading to the periphery of the board from the starting square, diagonal squares numbered alphabetically and a retirement square 89. Around the periphery of the board are ten company squares 5, 8, 12, 15, 20, 23, 27, 31, 34 and 40. There are twelve Welfare and Unemployment benefit spaces 6, 11, 13, 16, 18, 21, 24, 25, 30, 32, 36 and 41. There are four Welfare and Unemployment Payback spaces 4, 10, 19 and 29. Spaces 7, 14, 22, 26, 33 and 39 relate to payment of bills. Squares 9 and 28 are Employment offices. Space 37 is the Pay Day space and Income Tax. The remaining spaces are unmarked.

The game is played as follows. Initially one player is chosen as banker. He handles the paychecks and moves the paymaster token. The players select player tokens 83 and place them in the space marked "start". The banker places the paymaster token at space 37 to start the game.

In order to start the game, a player must roll a pair of numbers on the two dice. Once the player has rolled a pair, he or she rolls again and moves the number of spaces equal to the second roll of the dice. Once the one player has become active, the paymaster token is moved the number of spaces indicated by every roll of the dice, except as set out below.

There are two instances when the paymaster token is not moved. The first is when a player rolls a pair of numbers to start a game. The second is when a pair of sixes is rolled by a player. When an active player rolls a pair of sixes, the player receives a bonus check immediately and is allowed to roll again. The paymaster token moves only on the second roll.

The goal of the game is to receive two paychecks 51 from each company and proceed to retirement. The bonus checks 53 can be substituted for any company paycheck except the insurance company. The bonus checks also can cover payments up to $9,000.00 to the bank.

Figure 2:
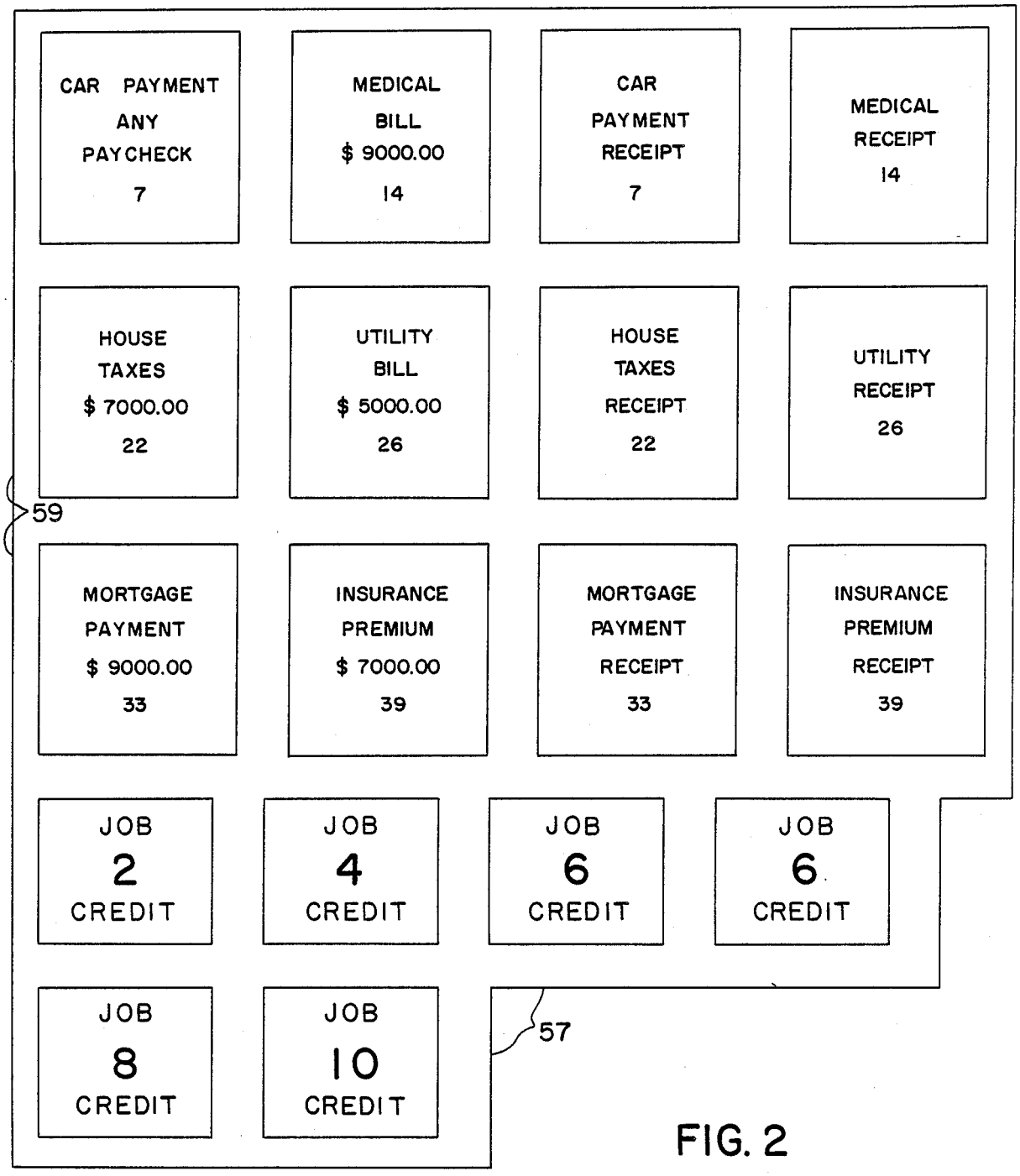
FIG. 2 shows specimen job credit cards and specimen bills and receipts.
Figure 3:
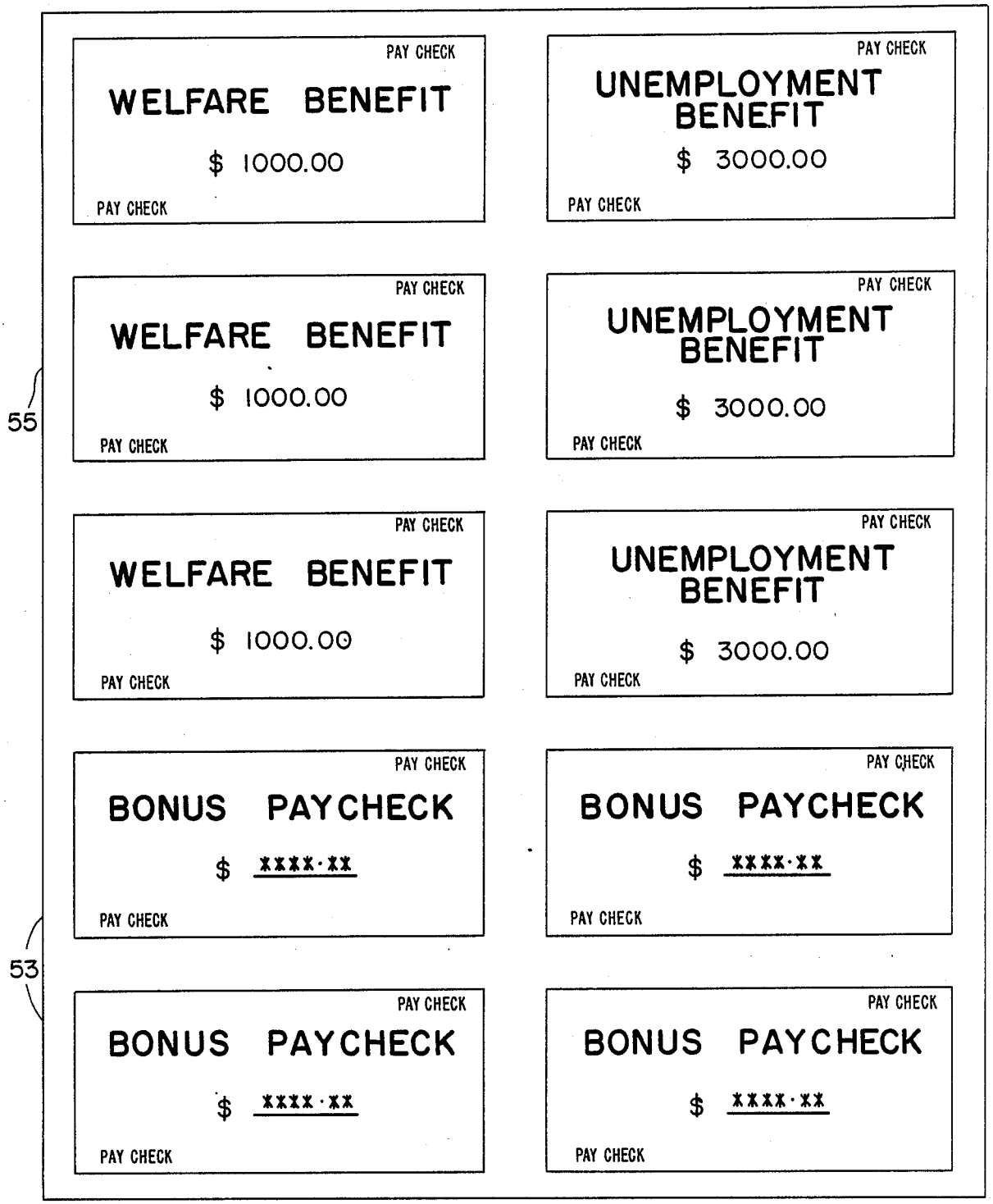
FIG. 3 illustrates specimen benefit and bonus checks.
Figure 4:
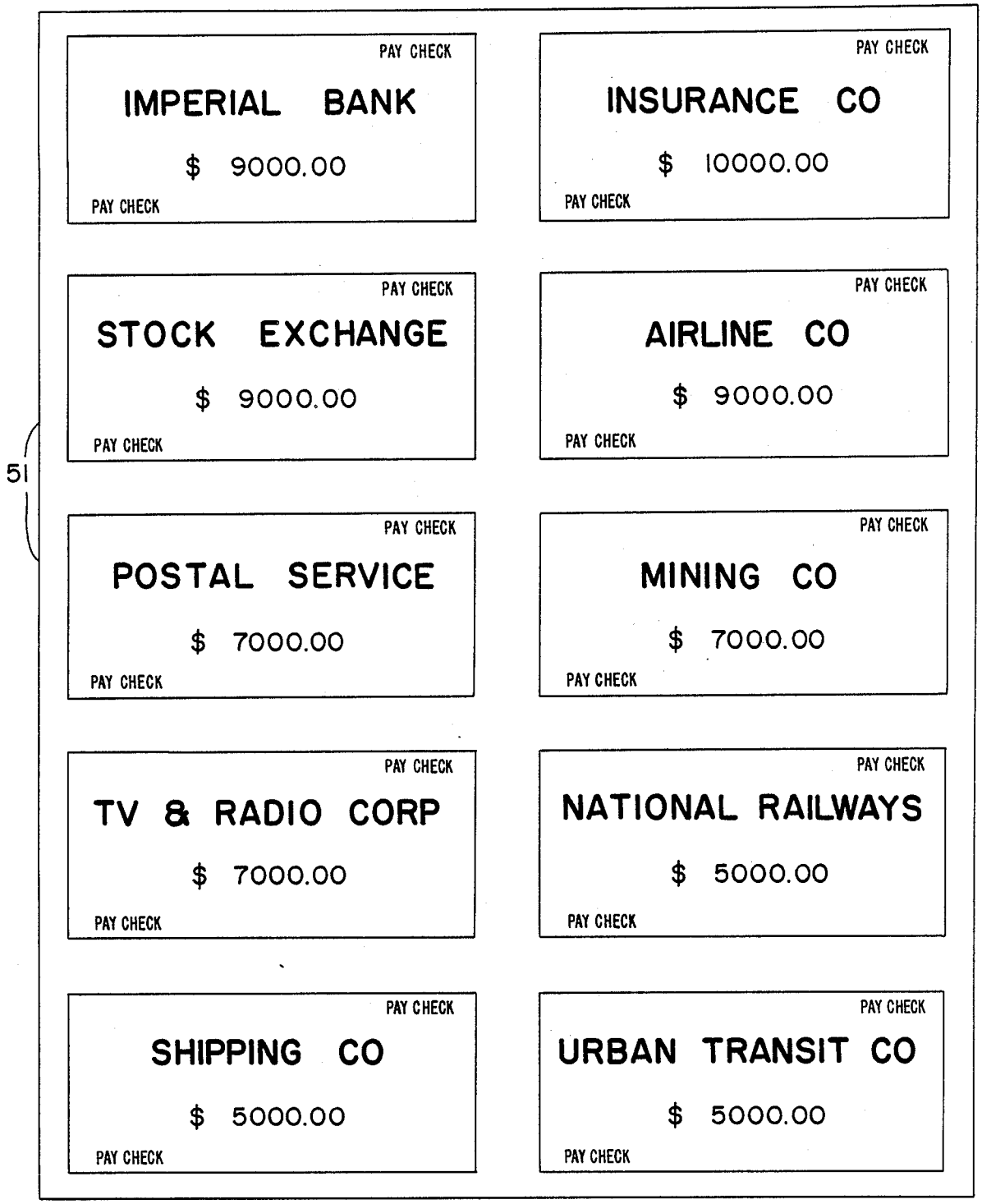
FIG. 4 illustrates specimen paychecks.

In order to land a job, a player must land on the numbered space of a company. On landing on a company's numbered space, the player may apply on his next turn for the job by rolling the dice. To qualify, the player must roll either two even or two uneven numbers on the two dice, but not necessarily a pair. If the player does roll a pair of sixes he or she does not qualify for the job, but instead receives a bonus paycheck and is allowed to roll again. If the player qualifies for the job, he or she may elect not to take the job and moves the number of spaces rolled instead. If the player is not qualified for the job he or she may stay on the square and try again on the next turn, or move ahead the number of spaces rolled. If the player takes the job he or she receives a job credit 57 from the bank and moves his or her token into the name space of the company. The job credit number is the amount rolled when applying for the job. As shown in FIG. 2 the job credit numbers are either 2, 4, 6, 8 or 10. The job credit numbers are important as another player may land on the numbered space of a company which already employs another player and may bump the player from that job by rolling a higher job credit number. If the player currently occupying the job has a job credit of 10 he or she cannot be bumped and a player landing at that job must move on the next turn. Whenever a player is bumped from a job, he or she moves his or her token back to the numbered spaces, returns the job credit number to the bank and on his next turn may either move around the board or attempt to bump the player that has just bumped him or her from the job.

While employed, that is, while the player's token is in the company's name space, the player continues to roll the dice on his or her turn in order to advance the paymaster.

A player must vacate a job after receiving two paychecks from the job. This is the case even where a player has used one or both paychecks to pay a debt to the bank. A player may have at most two paychecks per company in his or her possession.

A player landing on one of the employment office spaces 9 or 28 receives a job credit number 6 immediately. This credit allows the player to enter a job immediately upon reaching that space without further qualifying. The player on reaching the numbered space of a company has the option of retaining his or her job credit number 6 for future use and instead attempting to qualify for the job by rolling the dice on his or her next turn. When vacating a job, the player must return the job credit number which was used to obtain the job.

When a player lands on the Income Tax space number 37 he or she pays income tax immediately. The income tax payment is equal to the highest paycheck in the player's possession if the player has two or more paychecks, whether bonus paychecks or otherwise. Otherwise no tax is payable e.g. Welfare and unemployment benefits are not taxable.

Once the paymaster token has made a complete circuit of the board and has returned to the Payday square number 37 the paymaster token stops on the square even though all the spaces to be moved by the paymaster token have not been taken. The arrival of the paymaster token at the Payday square triggers a number of events. At that time all players pay the bank what is due according to the space they occupy, and the bank pays out paychecks to all players currently employed and benefit checks to players occupying welfare or unemployment benefit spaces. For example, if a player occupies spaces 7, 14, 22, 26, 33 and 39 he or she pays the bank the amount required and receives a receipt 59. That player cannot be billed for that same item again for the duration of the game. If a player is unable to pay the bank at that time he is billed and pays the bank as soon as he has sufficient funds, at which time he receives a receipt. The bank takes bonus checks, paychecks or benefit checks which total at least the amount owing to the bank, but the bank does not return any surplus.

If the player occupies squares 6, 11, 13, 16, 18, 21, 24, 25, 30, 32, 36 or 41 on Pay Day, he or she receives the appropriate Welfare or Unemployment benefit check 55. Those players on a Welfare or Unemployment benefit Payback space 4, 10, 19 ,or 29 on Pay Day pay to the bank one applicable benefit check if the player has one in his or her possession. Otherwise the player is exempted for that Pay Day only. Those players on one of the unmarked spaces on Pay Day pay and receive nothing. The Employment office and Income Tax spaces are effective immediately on the player landing there.

A player may decide to take a diagonal route from corner squares 18 or 37 and may move in either direction on a roll of the dice. The player may change direction on the next roll of the dice but may proceed only in one direction per roll of dice. On the outer periphery, however, the players always move in the clockwise direction. By using the diagonal route, the player may proceed more quickly to the desired job, and also will be liable to a greater income tax liability and may miss employment office credits.

Once the player has two paychecks from the insurance company and two paychecks from each of the other nine companies, where a substituted bonus; paycheck will count as a paycheck and has no outstanding debt, the player may retire. The player must proceed to the Retirement square but does not need to obtain the exact number to reach the square. Once the game is over, the richest retired player wins the game. A time limit may be set for the game at which time the richest retired player is determined, or the players may agree to end the game at a particular time to determine the winner.

Various modifications and alterations of the invention above described are possible without departing from the spirit of the invention, the scope of which is to be determined in accordance with the accompanying claims.

I claim:

1. A board game apparatus comprising:

(a) a game board having a continuous playing path comprising a plurality of consecutive spaces, certain of said spaces bearing indicia identifying such spaces as jobs capable of being held by a player of the game, certain others of said spaces bearing indicia representing bills to be paid, certain others of said spaces bearing indicia representing the payment of unemployment and welfare benefits;

(b) a plurality of movable playing pieces, one of said playing pieces being designated as a timing piece and the remainder of said playing pieces representing individual players;

(c) means for randomly selecting a number corresponding to the movement of a player;

(d) a plurality of cards, each card bearing indicia representing a paycheck from a particular one of said jobs;

(e) a plurality of bill payment cards, each card bearing indicia representing one of said bills to be paid and bearing indicia representing the amount of money payable for said bill; and (f) a plurality of cards representing amounts of money payable for said benefits; and (g) a plurality of cards representing receipts for payment of said bills.

2. A board game apparatus comprising:

(a) a game board having a continuous playing path comprising a plurality of consecutive spaces, certain of said spaces bearing indicia identifying such spaces as jobs capable of being held by a player of the game;

(b) a plurality of movable playing pieces, one of said playing pieces being designated as a timing piece and the remainder of aid playing pieces representing individual players;

(c) means for randomly selecting a number of corresponding to the movement of a player;

(d) a plurality of cards, each card bearing indicia representing a paycheck from a particular one of said jobs; and (e) employment experience cards, each card bearing an indicia corresponding to a number selected by said random number selection means, one of said cards being acquired when landing on a job space and selecting an appropriate number using said random number selection means.

3. A board game apparatus comprising:

(a) a game board having a continuous playing path comprising a plurality of consecutive spaces, and a plurality of spaces not in said continuous playing path, each of said spaces not in said continuous playing path being contiguous with one of said consecutive spaces, wherein said non-continuous spaces bear indicia identifying such spaces as jobs capable of being held by a player of the game and certain of said consecutive spaces bear indicia representing the payment of bills;

(b) a plurality of movable playing pieces;

(c) means for randomly selecting a number corresponding to the movement of a player;

(d) a plurality of cards, certain of said cards bearing indicia representing a paycheck from a particular one of said jobs and certain of said cards representing amounts of money payable for said bills; and (e) employment experience cards, each card bearing an indicia corresponding to a number selected by said random number selection means, one of said cards being acquired when landing on a job space and selecting an appropriate number using said random number selection means.

4. A board game apparatus comprising:

(a) a game board having a continuous playing path comprising a plurality of consecutive spaces, and a plurality of spaces not in said continuous playing path, each of said spaces not in said continuous playing path being contiguous with one of said consecutive spaces, wherein said non-continuous spaces bear indicia identifying such spaces as jobs capable of being held by a player of the game and certain of said consecutive spaces bear indicia representing the payment of bills, certain of said consecutive spaces bearing indicia representing the payment of welfare and employment benefits;

(b) a plurality of movable playing pieces;

(c) means for randomly selecting a number corresponding to the movement of a player;

(d) a plurality of cards, certain of said cards bearing indicia representing a paycheck from a particular one of said jobs and certain of said cards representing amounts of money payable for said bills; and (e) employment experience cards, each card bearing an indicia corresponding to a number selected by said random number selection means, one of said cards being acquired when landing on a job space and selecting an appropriate number using said random number selection means;

(f) welfare and unemployment benefit payment cards, each card bearing indicia representing one of said benefits and bearing indicia representing the amount of money payable to said benefit.

* * * * *